United States Patent [19]

Meyers

[11] 4,177,715

[45] Dec. 11, 1979

[54] METHOD OF MAKING PARTITIONED TRAY

[75] Inventor: George L. Meyers, Menasha, Wis.

[73] Assignee: American Can Company, Greenwich, Conn.

[21] Appl. No.: 870,989

[22] Filed: Jan. 20, 1978

Related U.S. Application Data

[62] Division of Ser. No. 796,220, May 12, 1977, Pat. No. 4,081,125.

[51] Int. Cl.[2] ..... B31B 17/00

[52] U.S. Cl. ..... 93/37 R; 93/36.6

[58] Field of Search ..... 93/36.6, 37 R, 37 SP, 93/37 EC, 1 D; 229/31 R, 27

[56] References Cited

U.S. PATENT DOCUMENTS

| | | | |
|---|---|---|---|
| 3,429,235 | 2/1969 | Ackley | 93/37 R |
| 3,590,699 | 7/1971 | Foley, Jr. et al. | 93/36.6 |
| 3,829,003 | 8/1974 | Dilot | 229/31 R |
| 4,075,107 | 2/1978 | Smith | 93/1 D |

*Primary Examiner*—James F. Coan

*Attorney, Agent, or Firm*—Robert P. Auber; George P. Ziehmer; Ira S. Dorman

[57] ABSTRACT

The method of making a compartmentalized paperboard tray with one or more point-of-use flip-up partitions. The tray is produced from roll stock paperboard by feeding one web over another, adhering the webs together at selected areas and then cutting and scoring the adhered webs together to provide a flat tray blank which may be set up on standard tray forming equipment.

2 Claims, 5 Drawing Figures

METHOD OF MAKING PARTITIONED TRAY

CROSS REFERENCE TO RELATED APPLICATIONS

This is a division of application Ser. No. 796,220, filed May 12, 1977 now U.S. Pat. No. 4,081,125.

BACKGROUND OF THE INVENTION

This invention relates generally to partitioned paperboard trays and the method of making same.

There has been a need for an economical method of producing a paperboard tray, either tapered or straight sided, with one or more point-of-use flip-up partitions. The trays must be inexpensive to produce, adapted to be set up on standard tray forming equipment, and preferably capable of being shipped either as flat tray blanks or nested trays. Such trays are in demand not only in the food processing and service fields, but also for packaging other products as well.

SUMMARY OF THE INVENTION

In summary, my invention resides in the production of a versatile paperboard tray with one or more point-of-use flip-up partitions. The partitions may be of the same or different caliper than the board from which the tray body is made and the partitions may be located at any desired position within the tray to provide compartments of various sizes. The tray body may be tapered or straight sided and may have glued or interlocked corners.

The method of making the trays is particularly economical in that the trays are formed from two roll stock paperboard webs which are continuously fed out and adhered together in superimposed relation and then cut and scored simultaneously in their mated relation. The trays can be shipped either in flat blank form for set up on conventional tray forming equipment or as nested trays with the partition lying flat against the bottom for erection at the point-of-use.

Other objects, features and advantages of my invention will be apparent from the following detailed description taken in conjunction with the accompanying drawings showing preferred embodiments of the invention for exemplification.

DETAILED DESCRIPTION OF PREFERRED EMBODIMENTS

Figure 1:
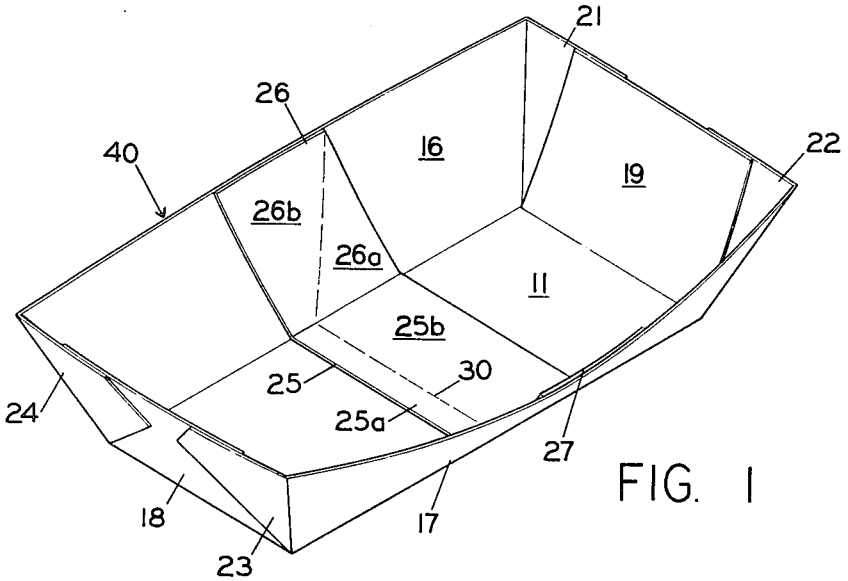
FIG. 1 is an isometric view of a tapered tray with a single flattened partition embodying the principles of my invention.
Figure 2:
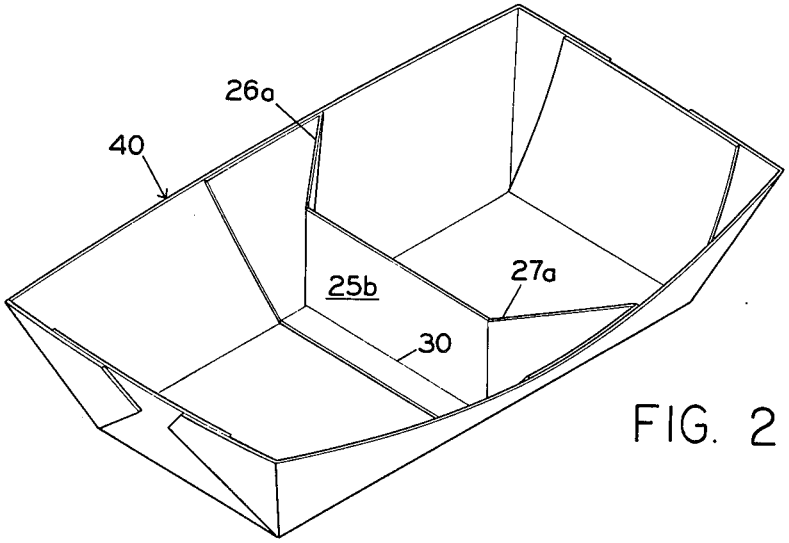
FIG. 2 is an isometric view of the tapered tray shown in FIG. 1 with the partition erected.
Figure 4:
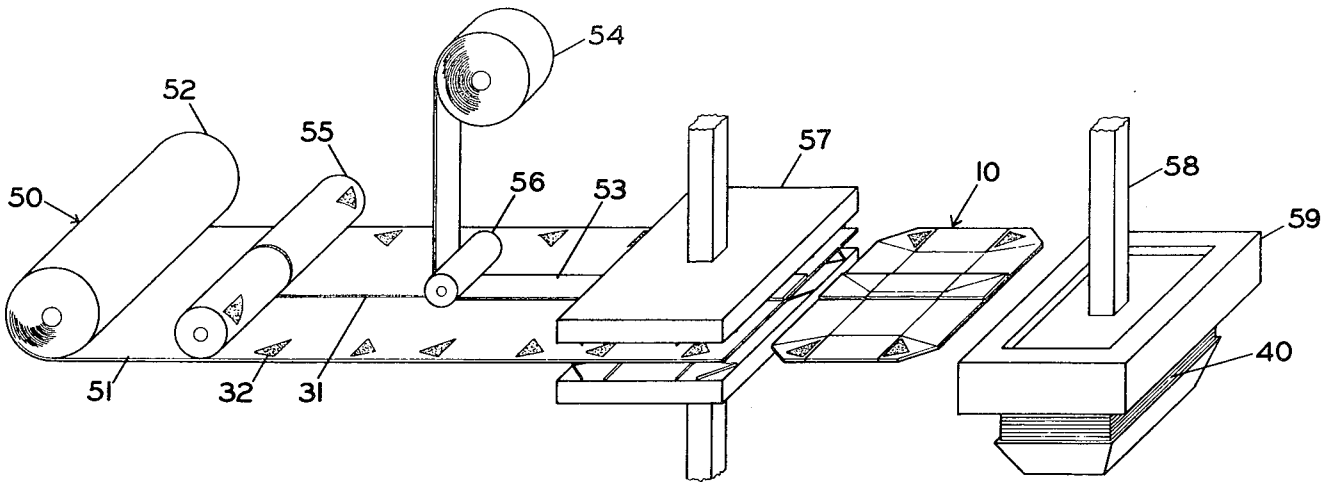
FIG. 4 is an isometric view of a straight sided tray with a single divider panel providing two partitions, one shown in its flattened position and the other in its erected position.
Figure 3:
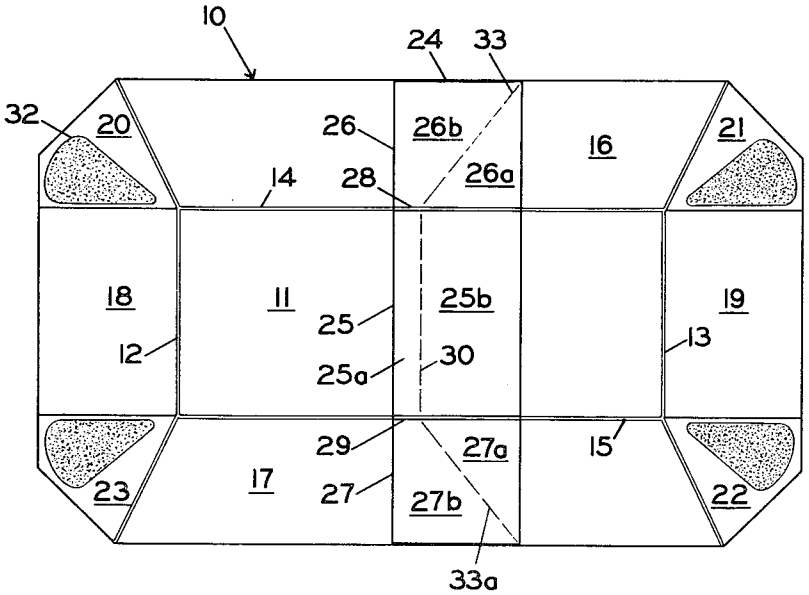
FIG. 3 is a plan view of the paperboard blank from which the tray shown in FIGS. 1 and 2 is formed.

Referring now more particularly to the drawings wherein like numerals refer to like parts throughout the several views, the tray 40 shown in FIGS. 1 and 2 is formed by the production method 50 and paperboard blank 10 depicted in FIGS. 3 and 4.

Referring first to FIGS. 3 and 4, the blank 10 is produced from a first continuous paperboard web 51 fed out from a stock roll 50 and a second narrower continuous paperboard web 53 fed out from a stock roll 56 over web 51 and adhered thereto in the overlapping or superimposed relation shown. Four adhesive spots such as shown at 32 are applied to web 51 by a suitable applicator such as glue roller 55 shown which also lays down an adhesive strip 31 on web 51. The areas to which the spots of adhesive 32 are applied are, of course, the areas which upon formation of the blank by cutting and scoring become corner tabs 20–23. The overlaying web 53 is engaged with the adhesive strip 31 on the underlaying web 51 by suitable means such as pressure roller 56 shown for adhering the webs together.

The mated webs then pass into the cutting and scoring die 57 shown in the drawings for exemplification as a reciprocal stamping type die. There the bottom or tray web 51 is cut and scored to provide a rectangular bottom panel 11 defined by a pair of side score lines 12 and 13 and the pair of primary end score lines 14 and 15, a pair of end walls 16 and 17 hingedly connected to the bottom panel along the primary end score lines, a pair of side walls 18 and 19 connected to the bottom panel along the pair of side score lines, and four corner tabs 20–23 for connecting the end walls and the side walls to form a tray body.

The die 57 cuts and scores the upper or divider web 53 to form the web into a divider panel 24 having a main portion 25 and a pair of end portions 26 and 27 which are hingedly connected to the main portion 25 along a pair of secondary side score lines 28 and 29 which respectively overlay the pair of primary end score lines 14 and 15. The web 53 is also formed with an attachment section **25*a* defined in main portion 25 by the pair of secondary score lines 28 and 29 and a fold line 30. A partition section 25*b* in the main portion of 25 is hingedly connected to the attachment section 25*a* along the fold line 30. The end portion 26 is divided by a biased fold line 33 into a triangular web section 26*a* and an end glue section 26*b*. The end portion 27 is similarily divided by a biased fold line 33*a* into a triangular web section 27*a* and an end glue section 27*b*. The cut end margins of the divider panel 24 and the bottom 11 are coterminous, as shown in FIGS. 3 and 4**, having been cut together by the same die edge.

As shown in FIG. 3, the fold lines 30, 33 and **33*a* in the overlaying divider web are of the cut perforation type. The depth of the die knives for forming fold lines 30, 33 and 33*a* is such that the underlying tray web 51** is preferably unscored thereby or at least not substantially scored or weakened thereby.

The method shown in FIG. 4 and described above produces the paperboard tray blank 10 shown in FIGS. 3 and 4. As shown in FIG. 4, the blank 10 may be set up into tray form 40 on conventional tray forming equipment such as a male and female mandrel 58 and 59, respectively. The male tray mandrel is inserted into a blank positioned over the female mandrel and forming the blank into a tray as it forces the blank through the female mandrel and into a nested stack of previously formed trays. The tray 40 formed is as shown in FIG. 1, wherein the partition section **25*b* lies flat against the bottom panel 11**.

The manufacturer could provide the product in either the flat blank form 10 shown in FIG. 3 or in the set-up tray form 40 shown in FIG. 1. If it was to be supplied in flat blank form, the adhesive spots, of course, would be of the heat sensitive type and would have to be dryed before stacking the blanks. In either case, the partition section **25*b* remains flat against the bottom panel 11 until it is manually erected at the point-of-use. To compartmentalize the tray at the point-of-use, one merely grasps the free edge of the partition section 25*b* and raises the partition section to the upright position shown in FIG. 2. The triangular web sections 26*a* and 27*a* act as hinge connections for maintaining the partition section 25*b*** in its upright position.

Figure 5:
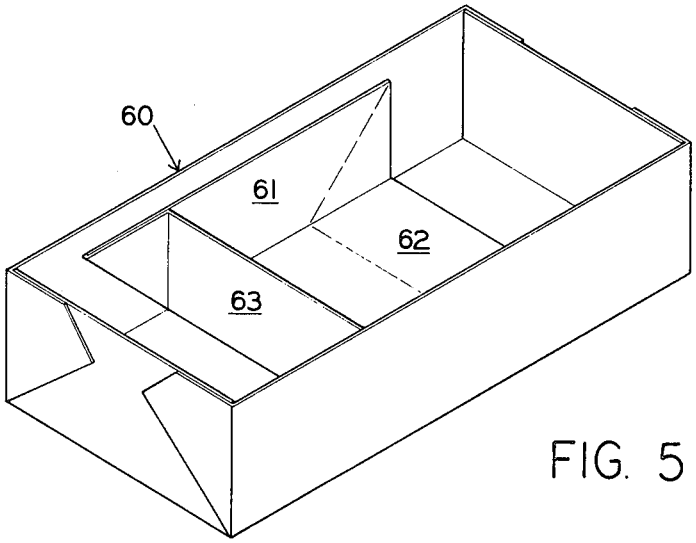
FIG. 5 is a diagrammatic drawing of a tray production method embodying the principles of my invention.

FIG. 5 shows a second tray embodiment 60 to illustrate that the principles of the invention are applicable to straight-sided trays as well as tapered trays and that more than one partition section may be provided. In the tray 60 shown in FIG. 5, two partition sections 62 and 63 are provided from a single divider panel 61, partition section 62 being shown in its flattened condition while partition section 63 is shown in its erected position. It is understood that any number of partition sections could be provided from a like number of divider webs or that utilizing the principle shown in FIG. 5, two partition sections can be formed from each divider web. Any desired number of partitions may be provided depending on the number and the size of the compartments desired in the tray.

It should also be understood that this invention is not confined to the particular construction or method herein illustrated and described for exemplification, but embodies all such modified forms thereof as come within the scope of the following claims.

I claim:

1. The method of making a paperboard tray, comprising the steps of:

(a) feeding a first paperboard web from a roll;

(b) feeding a second narrower paperboard web over said first web;

(c) adhering said webs in mated relation at selected areas; and (d) cutting and scoring said mated webs to form said first web into, (1) a rectangular bottom panel defined by a pair of side score lines and a pair of primary end score lines, (2) a pair of end walls hingedly connected to said bottom panel along said primary end score lines, (3) a pair of side walls hingedly connected to said bottom panel respectivley along said pair of side score lines, and (4) four corner tabs for connecting said end walls and said side walls together to form a tray body, and to form said second web into, (5) a divider panel having a main portion overlaying and coterminous with said bottom panel and having a pair of end portions respectively overlaying said end walls and being hingedly connected to said main portion along a pair of secondary side score lines which respectively overlay said pair of primary end score lines, (6) an attachment section defined in the main portion of said divider panel by said pair of secondary end score lines and a fold line, said attachment section being adhered to said bottom panel, (7) a partition section in the main portion of said first divider panel hingedly connected to said attachment section along said fold line, and (8) substantially triangular web sections and end glue sections defined in the end portions of said first divider panel by a pair of biased fold lines, said end glue sections being adhered to said end walls.

2. The method of making a paperboard tray as specified in claim 1 comprising the step of inserting a male tray mandrel into said cut, scored and mated webs to form them into a set-up tray with a folded-down partition for erection at the point-of-use.

* * * * *